US005372522A

United States Patent [19]

Hoeft

[11] Patent Number: 5,372,522

[45] Date of Patent: Dec. 13, 1994

[54] TWELVE VOLT DIRECT CURRENT ADAPTOR

[76] Inventor: John S. Hoeft, P.O. Box 1398, Olive Bridge, N.Y. 12461

[21] Appl. No.: 993,697

[22] Filed: Dec. 21, 1992

[51] Int. Cl.[5] ..... H01R 27/02

[52] U.S. Cl. ..... 439/535; 439/221; 439/654

[58] Field of Search ..... 439/638–655, 439/620, 621, 535, 536, 217–221, 362, 365

[56] References Cited

U.S. PATENT DOCUMENTS

| | | | |
|---|---|---|---|
| 2,044,948 | 6/1936 | Leon | 439/362 |
| 3,156,515 | 11/1964 | More | 439/652 |
| 3,360,708 | 12/1967 | Persen | 439/221 |
| 3,629,789 | 12/1971 | Szeremy | 439/651 |
| 4,767,359 | 8/1988 | Martell | 439/535 |
| 5,007,863 | 4/1991 | Xuan | 439/654 |

*Primary Examiner*—David L. Pirlot

[57] ABSTRACT

A twelve volt DC adaptor plugs into any home electrical outlet so as to permit a conventionally wired home to be used in combination with a solar-powered system that provides continuous twelve volt direct current to the conventional wiring system. The direct current output voltage is available through a circular socket which mates with a cigarette-lighter type plug available on most twelve volt direct current-using appliances. One embodiment of the adaptor offers a single connection socket, and a second embodiment incorporates two sockets.

1 Claim, 4 Drawing Sheets

Fig. 1
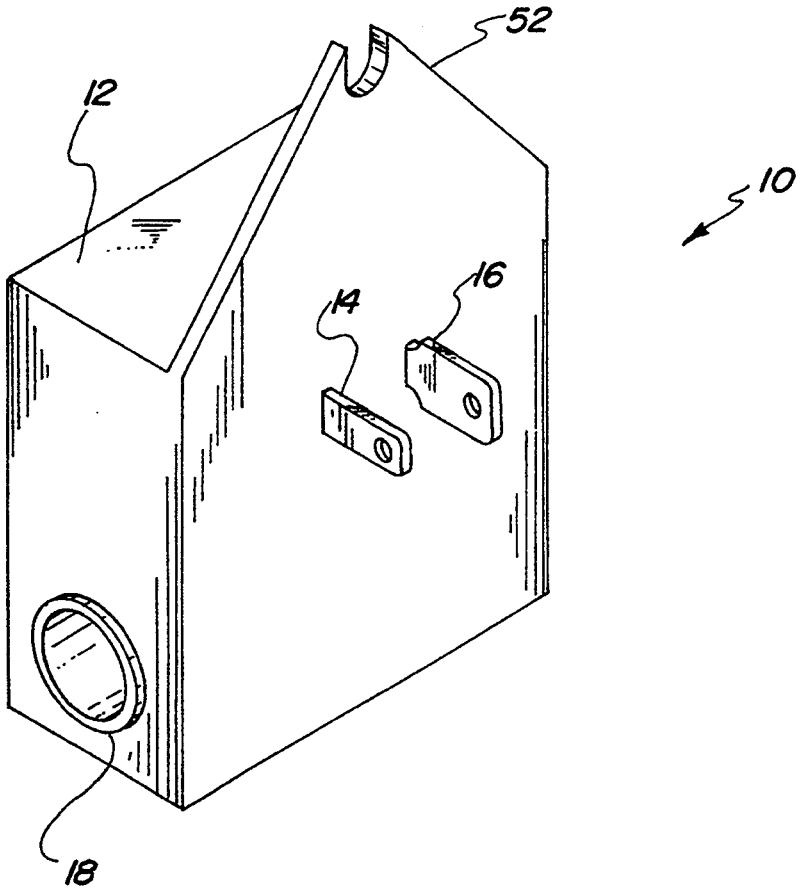
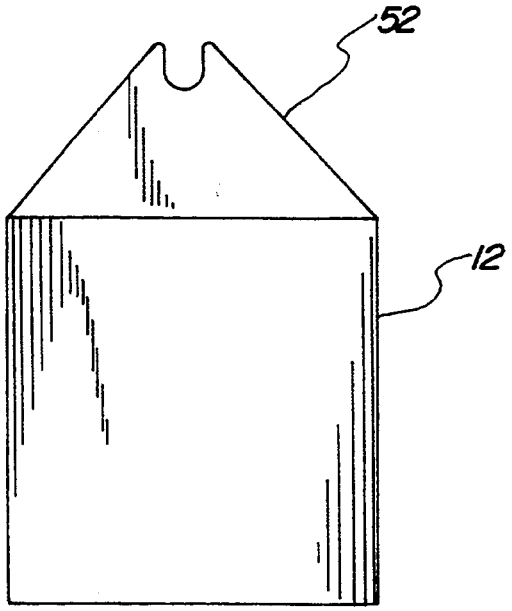
Fig. 2
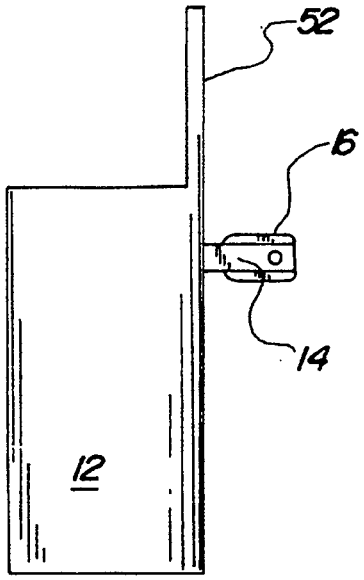
Fig. 3

Fig. 6
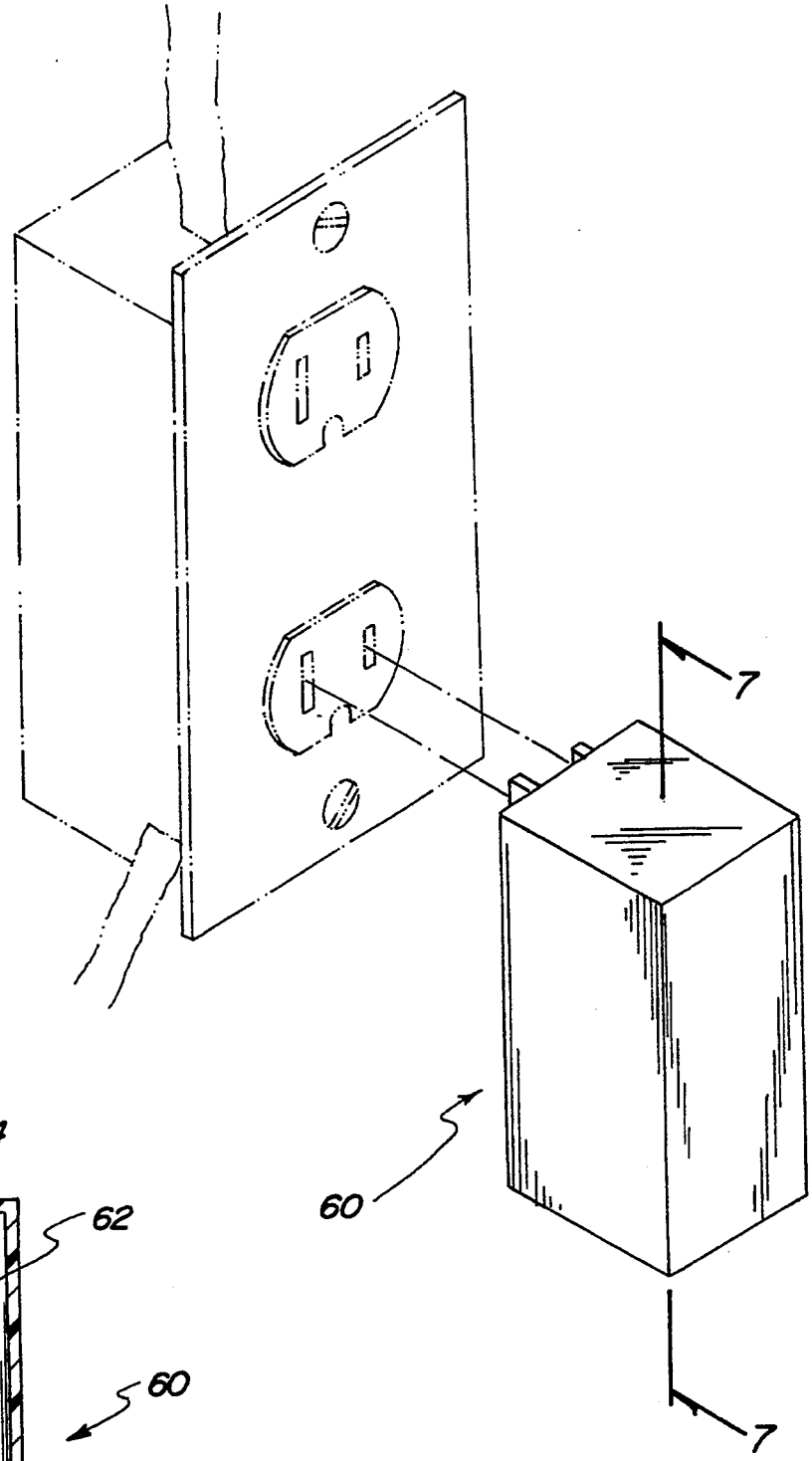
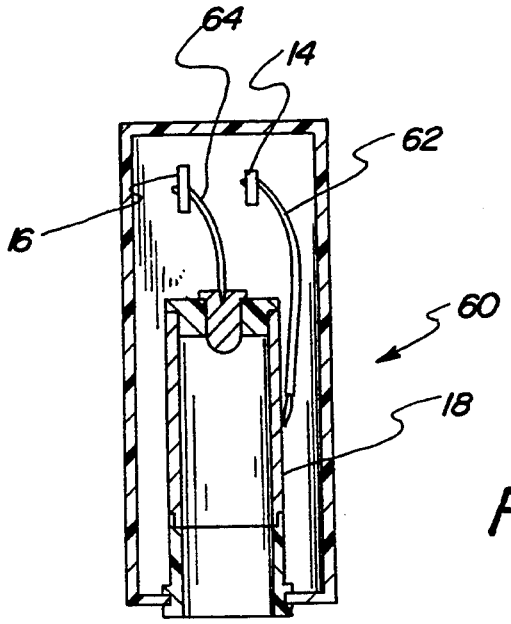
Fig. 7

TWELVE VOLT DIRECT CURRENT ADAPTOR

BACKGROUND OF THE INVENTION

1. Field of the Invention

The present invention relates to electrical devices, and more particularly pertains to an apparatus which facilitates the use of direct current appliances and equipment in a conventionally wired home.

2. Description of the Prior Art

In recent years, there has been developed and commercially sold various systems for providing twelve volt direct current to houses wherein the power is obtained from solar energy. Inasmuch as this twelve volt direct current could be supplied directly to the conventional wiring system of the home, wherein such wiring system normally supplies alternating current to a plurality of electrical outlets located in the home, it becomes logical to utilize the existing wiring system to supply the twelve volt direct current provided that some means could be found for connecting twelve volt appliances into existing electrical sockets. Unfortunately no twelve volt adaptors appear to be commercially available which would facilitate the supplying of solar power twelve volt direct current to an existing house wiring system and accordingly, the present invention substantially addresses this need.

SUMMARY OF THE INVENTION

In view of the foregoing disadvantages inherent in the known types of direct current adaptors now present in the prior art, the present invention provides an improved direct current adaptor construction wherein the same can be utilized to allow twelve volt direct current utilizing appliances to be electrically connected to an existing wiring system in a home. As such, the general purpose of the present invention, which will be described subsequently in greater detail, is to provide a new and improved direct current adaptor which has all of the advantages of the prior art direct current adaptors and none of the disadvantages.

To attain this, the present invention essentially comprises a twelve volt DC adaptor which plugs into any home electrical outlet so as to permit a conventionally wired home to be used in combination with a solar-powered system that provides continuous twelve volt direct current to the conventional wiring system. The direct current output voltage is available through a circular socket which mates with a cigarette-lighter type plug available on most twelve volt direct current-using appliances. One embodiment of the adaptor offers a single connection socket, and a second embodiment incorporates two sockets.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved direct current adaptor which has all the advantages of the prior art direct current adaptors and none of the disadvantages.

It is another object of the present invention to provide a new and improved direct current adaptor which may be easily and efficiently manufactured and marketed.

It is a further object of the present invention to provide a new and improved direct current adaptor which is of a durable and reliable construction.

An even further object of the present invention is to provide a new and improved direct current adaptor which is susceptible of a low cost of manufacture with regard to both materials and labor, and which accordingly is then susceptible of low prices of sale to the consuming public, thereby making such direct current adaptors economically available to the buying public.

Still yet another object of the present invention is to provide a new and improved direct current adaptor which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a first embodiment of the electrical power adaptor comprising the present invention.

FIG. 2 is a front elevation view of the invention.

FIG. 3 is a right side elevation view of the adaptor.

FIG. 6 is a perspective view of a third embodiment of the invention.

FIG. 7 is a cross-sectional view of the third embodiment.

DESCRIPTION OF THE PREFERRED EMBODIMENTS

Figure 4:
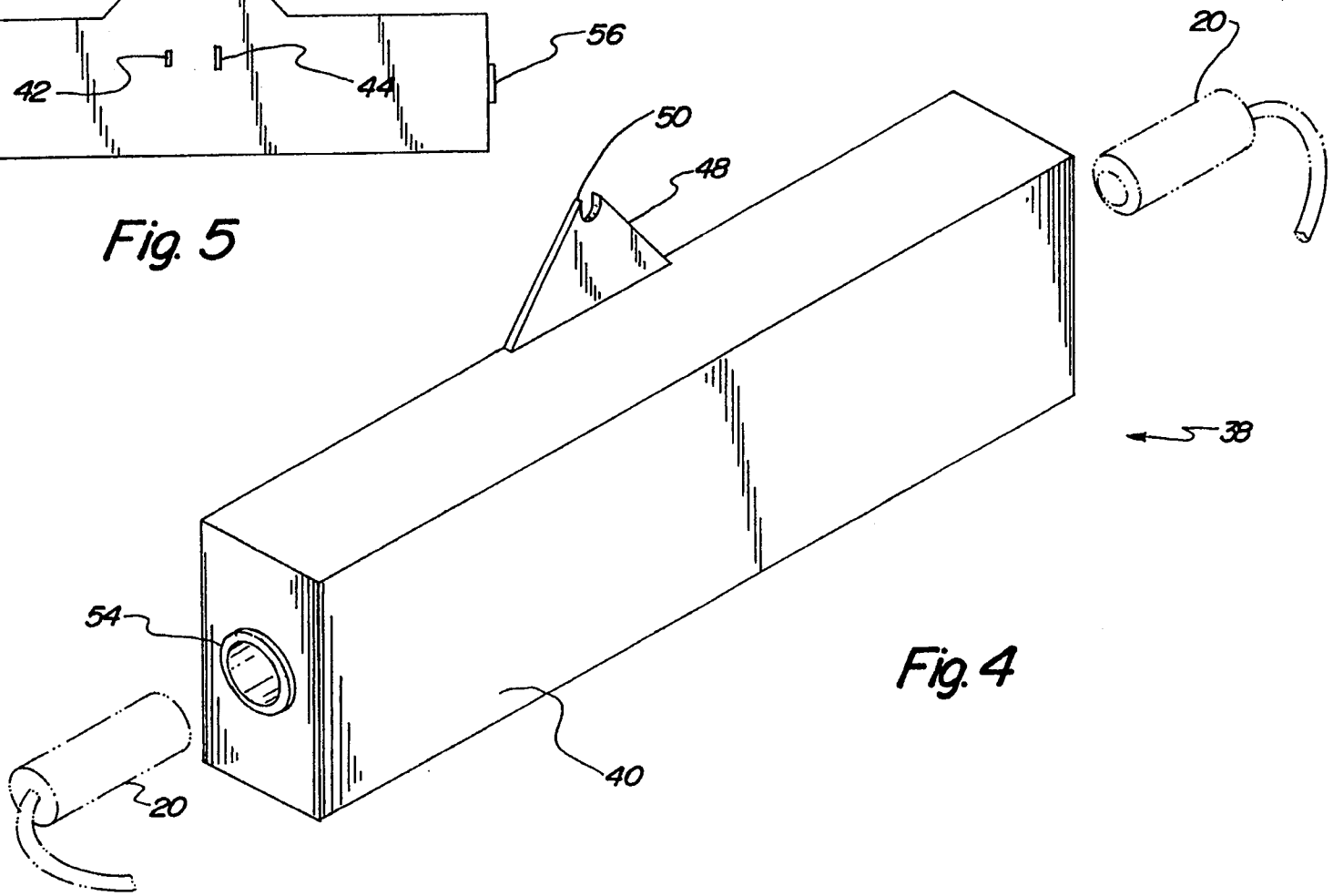
FIG. 4 is a perspective view of a second embodiment of the invention.

With reference now to the drawings, and in particular to FIGS. 1–3 thereof, a first embodiment of a new and improved twelve volt DC adaptor embodying the principles and concepts of the present invention and generally designated by the reference numeral 10 will be described.

More specifically, it will be noted that the first embodiment 10 essentially comprises an enclosed housing 12 having outwardly extending electrical power connection prongs 14, 16 designed for insertion into a conventional electrical power outlet. Further, a cigarette lighter type socket 18 is incorporated into the housing 12 and is designed to receive an adaptor plug 20 of the type shown in FIG. 4.

Figure 5:
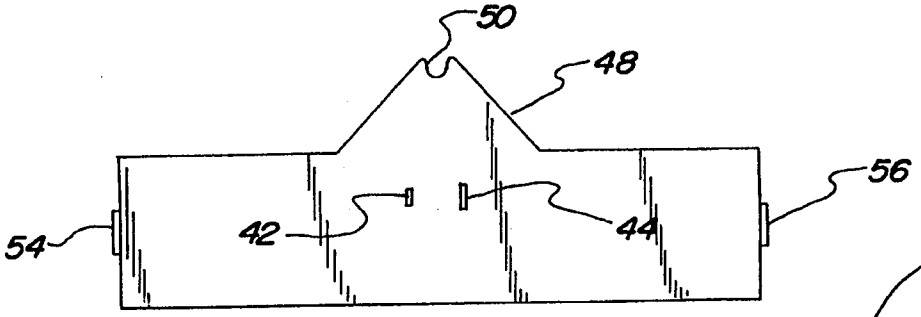
FIG. 5 is a rear elevation view of the second embodiment.

FIGS. 4 and 5 of the drawings illustrate a second embodiment of the invention which is generally designated by the reference numeral 38. This second embodiment 38 employs an enclosed housing 40 and includes a pair of electrical prongs 42, 44 for insertion into a standard electrical outlet. An upstanding integral support 46 includes a screw receiving detent 50 which facilitates a fastening of the housing 40 to the pre-existing center screw of an electrical outlet cover plate. This provides for additional support of the device due its size. A similar upstanding support 52 is illustrated with respect to the first embodiment 10 of the invention as shown in FIGS. 1–3. This second embodiment 38 of the invention is identical in all respects to the first embodiment 10 with the exception that two electrical sockets 54, 56 are employed to allow the concurrent attachment of two separate direct current driven appliances, such as televisions, radios, fans, razors, vacuum cleaners, and the like.

FIGS. 6 and 7 illustrate a slightly modified embodiment of the invention which is generally designated by the reference numeral 60. The modified embodiment 60 is substantially similar to the embodiment 10 shown in FIG. 1 of the drawings with the exception that the upstanding support member 52 has been removed. A cigarette lighter type socket 18 is shown in FIG. 7 having a ground electrical lead 62 attached to one prong 14 and a hot wire lead 64 attached to the other prong 16 wherein the prongs 14, 16 were previously described with reference to FIGS. 1–3 of the drawings. FIG. 7 of the drawings illustrates the electrical connection arrangement for directly connecting a cigarette lighter socket 18 to the prongs 14, 16 whereby the direct current adaptor 60 can be brought into electrical communication with an existing alternating current wiring system located in a home.

Figure 9:
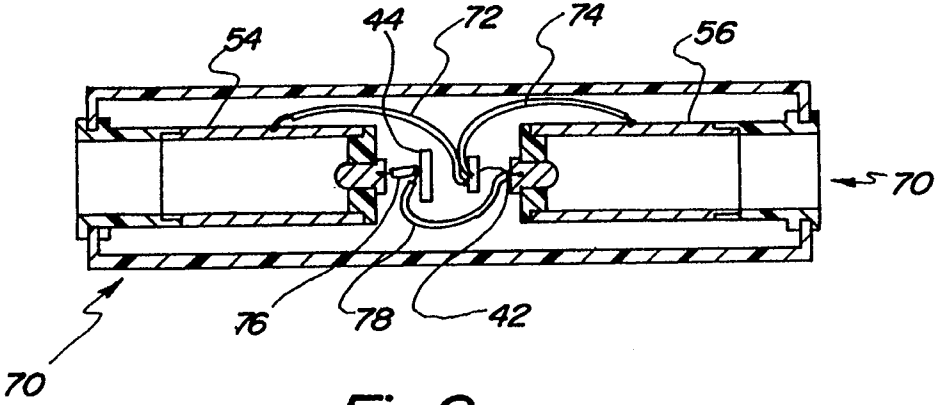
FIG. 9 is a cross-sectional view of the fourth embodiment.
Figure 8:
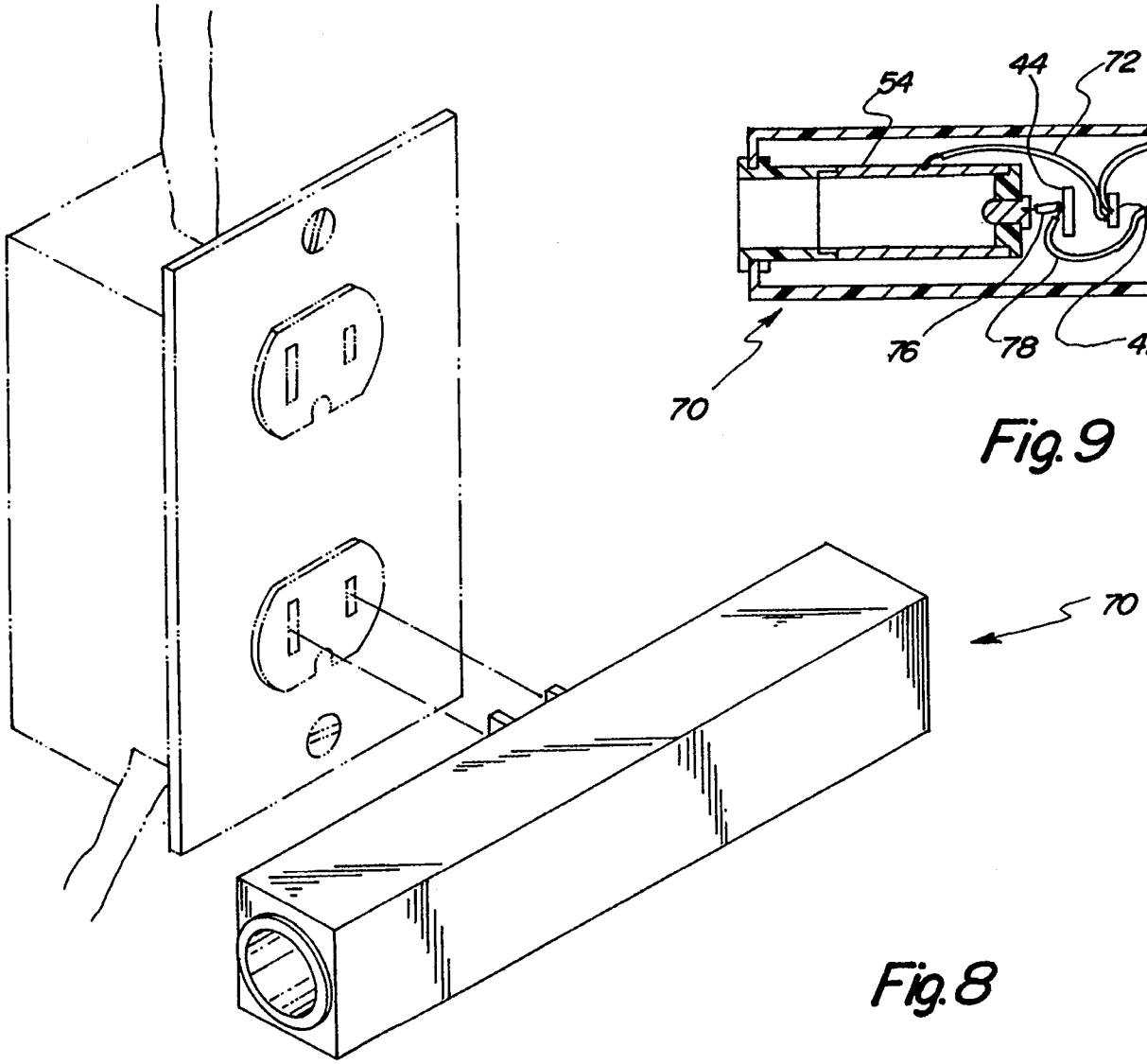
FIG. 8 is a perspective view of a fourth embodiment of the invention.

FIGS. 8 and 9 of the drawings illustrate a fourth embodiment of the invention which is generally designated by the reference numeral 70. The embodiment 70 is substantially identical to the embodiment 38 shown in FIG. 4 of the drawings with the exception that the upstanding support member 48 has been removed. As shown in FIG. 9, electrical ground wires 72, 74 electrically associated with cigarette lighter type connectors 54, 56 are both connected to the electrical prong 42, while a pair of hot wire leads 76, 78 associated respectively with the adaptors 54, 56 are both electrically connected to the prong 44. This effectively describes the electrical connection system for the embodiment 70 of the invention as well as the embodiment 38.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A twelve volt DC adaptor comprising:

a housing having parallel side walls, a top wall of a top wall width, a bottom wall, and a vertical center axis extending through a center of said top, a center of said bottom wall, and parallel to said side walls;

electrical prong means for attaching said housing to a conventional electrical supply wall outlet and to further facilitate a supplying of direct current to said housing through a conventional electric wire system which is normally used for an alternating electric current supply in a building, said electrical prong means comprising a first prong having a first height and a second prong having a second height, wherein said first height is greater than said second height such that said prong means engages said outlet in a predetermined polarity; and first direct current outlet means formed in said housing and being in electrical communication with said electrical prong means, said first direct current outlet means comprising a first cigarette lighter socket for receiving a first cigarette lighter plug, thereby to facilitate a delivery of direct current from said conventional electric wire system to an appliance which normally operates on direct current, further including integral support means, said integral support means comprising an upstanding flange for attachment to a center screw having a center screw width and being associated with said wall outlet, thereby to provide additional support to said housing when said housing is attached to said wall outlet, said upstanding flange having a flange lower end with a flange lower end width equal to said top wall width, said flange tapering to a flange top end having a flange top end width less than said flange lower end width and substantially greater than said center screw width such that torque applied to said housing about said vertical center axis is transferred to said flange lower end and is counteracted by an engagement of said flange lower end against said wall outlet, and further including a second direct current outlet means formed in said housing, said second direct current outlet means comprising a second cigarette lighter socket for receiving a second cigarette lighter plug, thereby to facilitate a concurrent supplying of direct current to a second appliance operable on direct current, said first and said second sockets being oppositely aligned in said housing below said upstanding flange.

* * * * *